United States Patent [19]

Lee

[11] Patent Number: 4,632,451

[45] Date of Patent: Dec. 30, 1986

[54] WHEELCHAIR TABLE AND DESK ATTACHMENTS

[76] Inventor: Henry D. Lee, 207 W. Orchard, Selah, Wash. 98942

[21] Appl. No.: 827,512

[22] Filed: Feb. 10, 1986

[51] Int. Cl.[4] ..... A47B 83/02

[52] U.S. Cl. ..... 297/153; 108/137; 248/201; 280/289 WC; 403/4; 403/167

[58] Field of Search ..... 280/289 WC; 297/153, 297/148; 248/201; 403/167, 168, 4; 296/95 R; 108/137

[56] References Cited

U.S. PATENT DOCUMENTS

| | | | |
|---|---|---|---|
| 2,937,694 | 5/1960 | Willson et al. | 297/153 |
| 3,097,884 | 7/1963 | Alford | 297/153 |
| 3,146,738 | 9/1967 | Telarico | 297/148 X |
| 3,278,225 | 10/1966 | Stine | 297/148 |
| 3,495,519 | 2/1970 | Alfsen et al. | 108/137 |
| 3,635,522 | 1/1972 | Kerwit | 297/153 |
| 4,074,683 | 2/1978 | Di Chiara | 135/67 |
| 4,158,428 | 6/1979 | Bates | 224/42.42 |
| 4,223,944 | 9/1980 | DeLong | 297/148 |
| 4,339,061 | 7/1982 | Dunn | 224/42.42 |
| 4,403,786 | 9/1983 | Ulics | 280/289 |
| 4,428,616 | 1/1984 | Hamilton | 297/145 |
| 4,436,339 | 3/1984 | Albers | 297/153 |
| 4,484,755 | 11/1984 | Houston | 280/33.90 |
| 4,526,419 | 7/1985 | Bowman | 297/153 |

*Primary Examiner*—John A. Pekar

*Attorney, Agent, or Firm*—Joan H. Pauly

[57] ABSTRACT

A tabletop (32) is releasably attached to the armrest structure (4) of a wheelchair (2) by means of two mounting tubes (52). Each tube (52) has a rubber coated rear end portion (56) that is received into and frictionally engages an axial passageway (10) in a longitudinally extending upper horizontal frame member (6) of structure (4). Tube (52) extends along the lower surface (34) of tabletop (32) between the vertical flanges (46) of a pair of angle irons (40) secured to surface (34). A pair of longitudinally spaced bolts (76) extend through aligned openings (48,54) in flanges (46) and tube (52). Wing nuts (82) secure tube (52) against lateral movement along bolts (76) but may be loosened to permit lateral adjustment of the distance between tubes (52). The rear end (56) of the tube (52) may be replaced by a clamp (60) to engage an armrest structure (4') lacking an open axial passageway. Tabletop (32) may be replaced by a hinged desk top arrangement (32',88).

12 Claims, 8 Drawing Figures

WHEELCHAIR TABLE AND DESK ATTACHMENTS

DESCRIPTION

1. Technical Field

This invention relates to attachments for wheelchairs and, more particularly, to such an attachment having two elongated members that releasably engage opposite front frame portions of the wheelchair and that are secured to and laterally adjustable with respect to a tabletop or a desktop.

2. Background Art

People who are confined to wheelchairs are becoming increasingly mobile in our society and are actively participating in an everwidening range of occupational and educational situations. In many of these situations, the tables and desks are not suitable for use by a person in a wheelchair. Providing specialized furniture that can accommodate wheelchairs is generally not a practical option because it would require such furniture in a fairly large number of locations with each item of furniture being used only part time or occasionally. A more practical and cost effective alternative is to equip individual wheelchairs with attachments that can serve as tables and/or desks for the occupants. Unfortunately, there are very few such attachments commercially available, and the few attachments that are available tend to have significant drawbacks. For example, the most commonly found attachments are attached to the wheelchair by means of strips of interlocking plastic fibers, such as the material marketed under the trademark VELCRO. This kind of attachment does not provide sufficient strength for reliable everyday use.

There have been a number of proposals for wheelchair attachments that have been patented. To the knowledge of the applicant, most of these proposed attachments have never been marketed to any significant degree. In addition, the proposed attachments generally have disadvantages, such as insufficient strength, unduly complicated and therefore expensive and/or impractical structures, insufficient adjustability, and poor interface with unmodified wheelchairs.

Attachments for wheelchairs are disclosed in U.S. Pat. No. 3,278,225, granted Oct. 11, 1966, to C. A. Stine; U.S. Pat. No. 4,158,428, granted June 19, 1979, to C. W. Bates; U.S. Pat. No. 4,223,944, granted Sept. 23, 1980, to H. D. DeLong; U.S. Pat. No. 4,339,061, granted July 13, 1982, to P. Dunn; U.S. Pat. No. 4,403,786, granted Sept. 13, 1983, to G. Ulics; U.S. Pat. No. 4,428,616, granted Jan. 31, 1984, to R. Hamilton; U.S. Pat. No. 4,436,339, granted Mar. 13, 1984, to A. L. H. Albers; and U.S. Pat. No. 4,484,755, granted Nov. 27, 1984, to R. Houston. A tray attachment for a walker is disclosed in U.S. Pat. No. 4,074,683, granted Feb. 21, 1978, to A. J. Di Chiara.

Stine discloses a tray that is mounted on a pair of carrier arms each of which is hingedly attached to a clamp that fits around a horizontal armrest portion of the wheelchair. The tray is attached to the carrier arms by means of screws. The screw openings in the carrier arms are elongated slots to allow for longitudinal adjustment of the tray on the arms.

Bates discloses a basket attachment having horizontal arms that are "adjustably fixed" to opposite sides of the basket and that fit over the horizontal armrest portions of the wheelchair. The details of the attachment between the basket and the horizontal arms are not disclosed.

Ulics discloses a relatively complicated basket/tray attachment having a horizontal arm and an inclined arm on each side for hooking onto the wheelchair. The arms have fingers that are received into slots in the forward basket portion of the attachment. The bottom of the rear tray portion of the attachment has slots therein for receiving fasteners to attach the tray to the arms in a laterally adjustable manner.

Hamilton discloses a desk top attachment that folds in half and is pivotably attached to a forward vertical support to be movable into a stored position located where a conventional armrest would be provided. Hamilton states that vertical support posts can be mounted to be laterally adjustable, but the manner in which this might be accomplished is unclear.

Houston discloses a shopping cart attachment that is secured to the forward vertical supports of the armrests by V-shaped clamps that are secured by chains.

The above patents and the prior art that is discussed and/or cited therein should be studied for the purpose of putting the present invention into proper perspective relative to the prior art.

3. Disclosure of the Invention

The subject of the invention is an attachment for a wheelchair or the like of the type having an armrest structure on each side thereof. According to an aspect of the invention, the attachment comprises a rigid generally planar member positionable in front of an occupant of the wheelchair. The planar member has a substantially horizontal surface, and a pair of substantially vertical mounting flanges is secured to each side of this horizontal surface and has aligned openings extending laterally therethrough. An elongated member extends rearwardly along the horizontal surface between each pair of flanges. Each elongated member has an opening extending laterally therethrough aligned with the openings in the corresponding flanges, and each such member is adjustably secured to the coresponding flanges. A bolt extends through the aligned openings in each pair of flanges and the corresponding elongated member and is secured to the flanges. Adjusting means is provided for releasably securing each elongated member against lateral movement along the corresponding bolt. The adjusting means is releasable to permit the elongated member to be slid laterally along the bolt to adjust the distance between the elongated members to the distance between the armrest structures. Each elongated member carries attaching means for releasably attaching such elongated member to a front portion of the corresponding armrest structure.

The attaching means may take a variety of forms. There are two preferred embodiments of the attaching means, with the choice between the two embodiments being dictated largely by the type of armrest structure of the wheelchair with which the attachment is to be used. The first preferred embodiment of the attaching means is designed to be used with an armrest structure that includes a substantially horizontal longitudinally extending frame member having a forward radial end and an axial passageway opening onto such end. A rearwardly projecting end portion of each elongated member is dimensioned to be closely received into the axial passageway in the corresponding frame member. Preferably, each of the end portions has a coating thereon to provide a frictional engagement between such end portion and the frame member into which it is received, to prevent inadvertent movement of such end portion relative to the frame member.

The second preferred embodiment of the attaching means comprises clamp means secured to the rear end of each elongated member. The clamp means is preferably a U-shaped member having two opposite generally vertical leg portions for receiving a part of the armrest structure therebetween. Means is provided for moving the leg portions together to firmly grip such part of the armrest structure. Preferably, the leg portions have aligned openings extending laterally therethrough, and a nut is welded to the outer surface of one of the leg portions in alignment with the opening therethrough. In such case, the means for moving the leg portions together comprises a threaded bolt having a head portion with finger grip means. This arrangement has the advantages of being simple, inexpensive, and easy to operate.

The planar member of the attachment may be varied considerably to suit the needs of different types of situations. One embodiment of a planar member is an essentially flat board having an upper surface that serves as a tabletop for use by the occupant and an opposite lower surface which forms the horizontal surface to which the mounting flanges are secured. Another embodiment of the planar member comprises an essentially flat board having a central opening extending vertically therethrough for receiving a receptacle, such as a desk pan, and a lower surface forming the horizontal surface to which the flanges are secured. Preferably, a cover is hingedly attached to a front edge portion of the board and has a closed position in which it rests on top of the board and covers the central opening and any receptacle received therein. This arrangement is particularly useful as a desk for a student.

The attachment of the invention has a number of other preferred features. One such feature is the provision of an L-shaped member corresponding to each flange. Each L-shaped member has a first leg parallel to and securely attached to the horizontal surface, and a second leg which forms the corresponding flange. Another preferred feature is forming the elongaged members from metal tubes. This feature helps to minimize the cost of the attachment and reduces its weight while maintaining structural strength. Another preferred feature is providing each set of flanges and the corresponding elongated member with two sets of longitudinally spaced aligned openings and extending a threaded bolt through each set of openings. This arrangement helps to increase the strength and stability of the attachment and prevent any wobbling of the planar member. Preferably, the adjusting means includes a pair of nuts threadedly received onto each bolt on opposite sides of the corresponding elongated member.

The attachment of the invention has a number of advantages. An important advantage is the provision of a strong and secure attachment between the planar member and the wheelchair that will withstand a wide range of use and abuse. The attachment of the invention is also relatively simple in construction and therefore inexpensive to manufacture, easy to maintain and operate, and readily adjustable to different types of wheelchairs. The versatility of the attachment is further enhanced by its ability to incorporate a variety of types of planar members.

These and other advantages and features will become apparent from the detailed description of the best modes for carrying out the invention that follows.

BRIEF DESCRIPTION OF THE DRAWINGS

In the drawings, like element designations refer to like parts throughout, and.

BEST MODES FOR CARRYING OUT THE INVENTION

Figure 1:
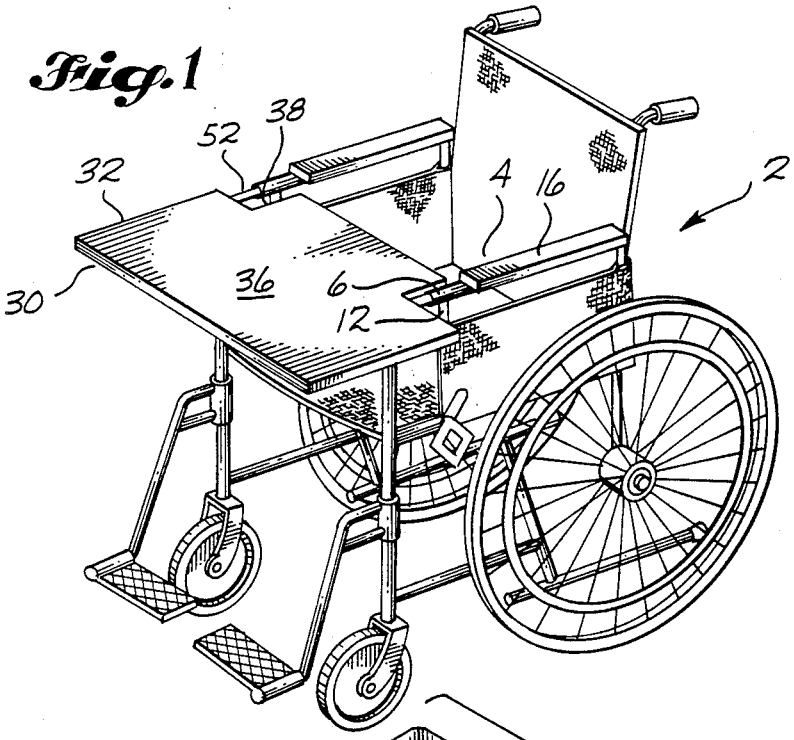
FIG. 1 is a pictorial view of a wheelchair to which a first preferred embodiment of the invention has been secured.
Figure 2:
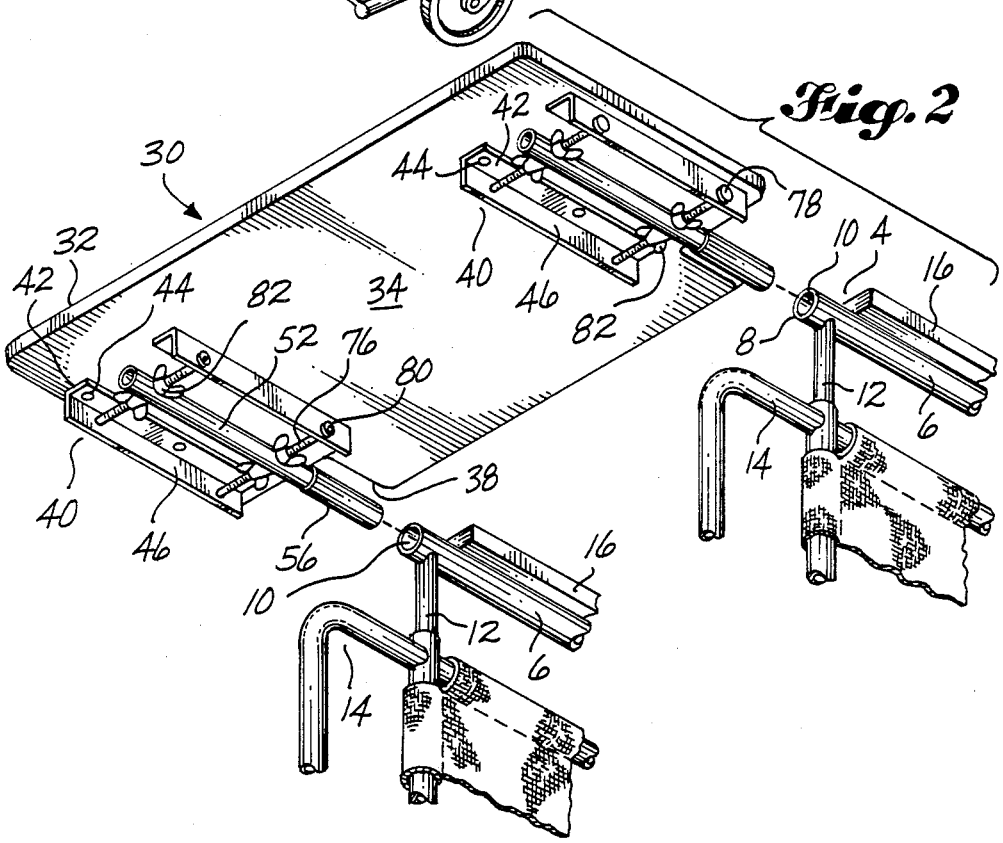
FIG. 2 is a partially exploded pictorial view of the attachment and front portions of the armrest structures shown in FIG. 1, looking toward the underside of the attachment.
Figure 6:
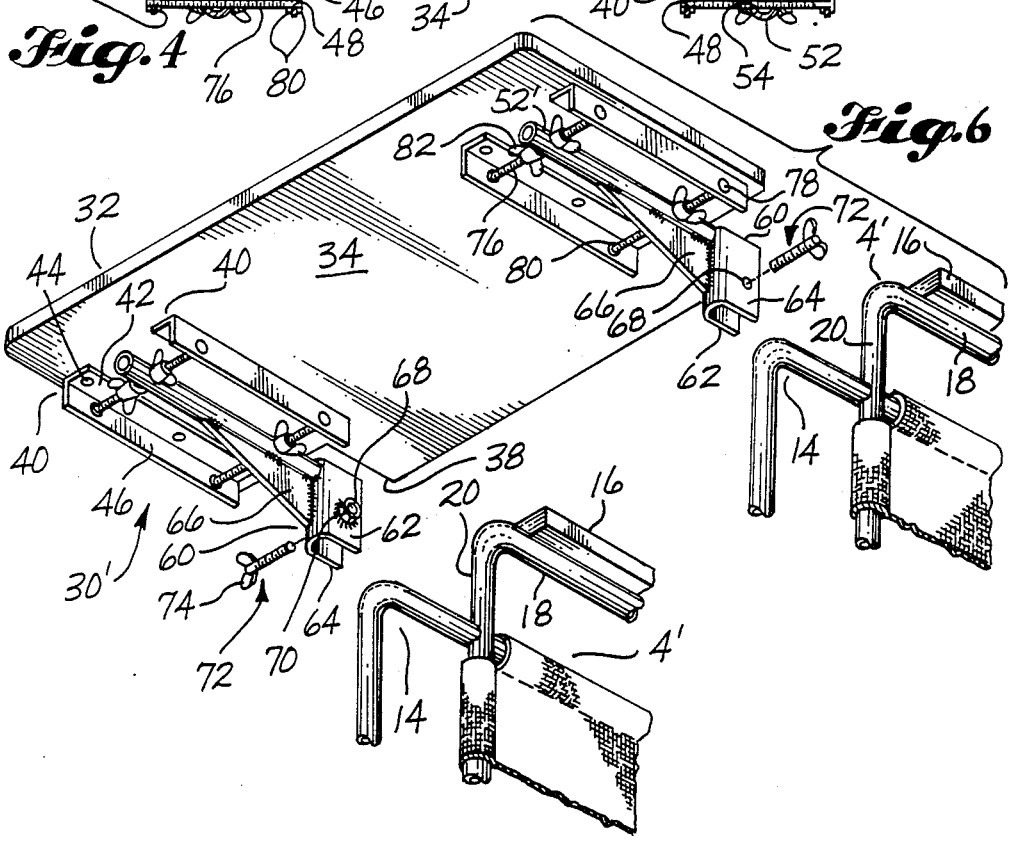
FIG. 6 is like FIG. 2 except that it shows a second preferred embodiment of the attachment and a different form of armrest structure.
Figure 5:
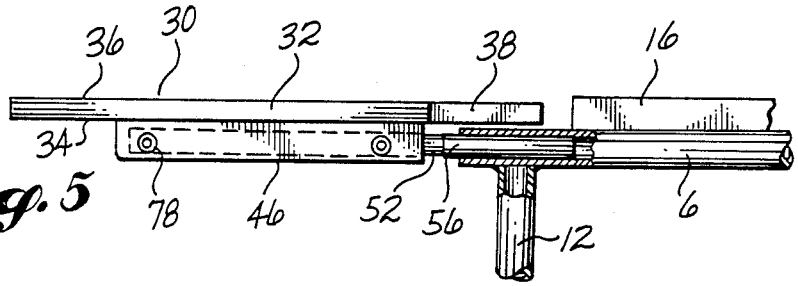
FIG. 5 is a side elevational view of the attachment and front portions of the armrest structure shown in FIG. 1, with parts shown in section.
Figure 7:
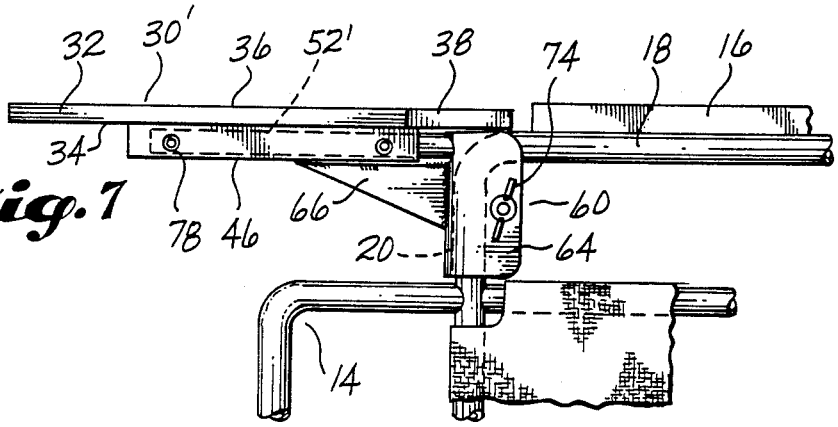
FIG. 7 is a side elevational view showing the attachment and armrest structure of FIG. 6 secured together.

The drawings show attachments 30,30',30" that are constructed according to the invention and that constitute the best modes for carrying out the invention currently known to the applicant. FIGS. 1, 2, and 5 show one embodiment of the attachment 30 being used in connection with a wheelchair 2 having an armrest structure 4. FIGS. 6 and 7 illustrate another embodiment of the attachment 30' in connection with a modified armrest structure 4'. The wheelchair 2 and the armrest structures 4,4' are shown herein for the purpose of illustrating a typical wheelchair and typical armrest structures with which the attachment of the invention may be advantageously used. It is of course to be understood that the attachment of the invention may also be used with other types of wheelchairs and other types of armrest structures without departing from the spirit and scope of the invention.

The armrest structure 4 shown in FIGS. 1, 2, and 5 has an upper longitudinally extending horizontal frame member 6 that is attached to a front vertical frame member 12, preferably by welding. The structure 4 also includes another frame member 14 positioned below member 6. This member 14 extends horizontally forwardly from vertical member 12 and then bends 90° to extend vertically downwardly. Each of the frame members 6, 12, 14 is constructed from metal tubing in a known manner to provide a strong and lightweight structure 4. A pad 16 is preferably provided on the top of horizontal frame member 6 for the comfort of the user. A forwardly directed axial passageway 10 opens onto the forward radial end 8 of horizontal frame member 6.

The modified armrest structure 4' shown in FIGS. 6 and 7 is similar to the structure 4 shown in FIGS. 1, 2, and 5. The major difference is that the upper longitudinally extending horizontal frame member 18 of armrest structure 4' does not have an open axial passageway like frame member 6 of structure 4 but rather at its forward end bends at a right angle to integrally form a vertical frame member 20 corresponding to member 12. The structure 4' has a lower frame member 14 and a pad 16 like the structure 4.

The first preferred embodiment of the attachment 30 shown in FIGS. 1–5 is designed to be used with armrest structures of the type shown in FIGS. 1, 2, and 5. The attachment 30 includes a flat board of tabletop 32 and tubular members 52 which securely but releasably attach the tabletop 32 to the armrest structure 4. The main forward portions of the tubes 52 are secured to and are laterally adjustable with respect to the tabletop 32. The rear end portions of the tubes 52 are adapted to releasably engage the horizontal frame members 6 of the armrest structure 4. The rearwardly projecting end portion of each tube 52 is dimensioned to be closely received into the axial passageway 10 in the corresponding horizontal frame member 6. Preferably, each of the rear end portions has a rubber coating 56 thereon to provide a frictional engagement between the tube 52 and the inner sidewalls of the frame member 6 into which it is received. The tight fit and the frictional engagement between the rubber 56 and the frame member 6 prevent inadvertent movement of the tube 52 relative to the frame member 6.

The tabletop 32 of the attachment 30 has a top surface 36 for the use of the occupant of the wheelchair 2 and a lower surface 34. The forward portion of the tabletop 32 is wider than the armrest structure to maximize the use surface 36. The rear portion 38 of the tabletop 32 is narrower than the armrest structure 4 so that it may project between the opposite frame members 6 toward the occupant of the wheehchair 2 to further increase the total area of the use surface 36 and bring it closer to the occupant. The tabletop may be made from a variety of materials, such as cabinet grade plywood.

Figure 3:
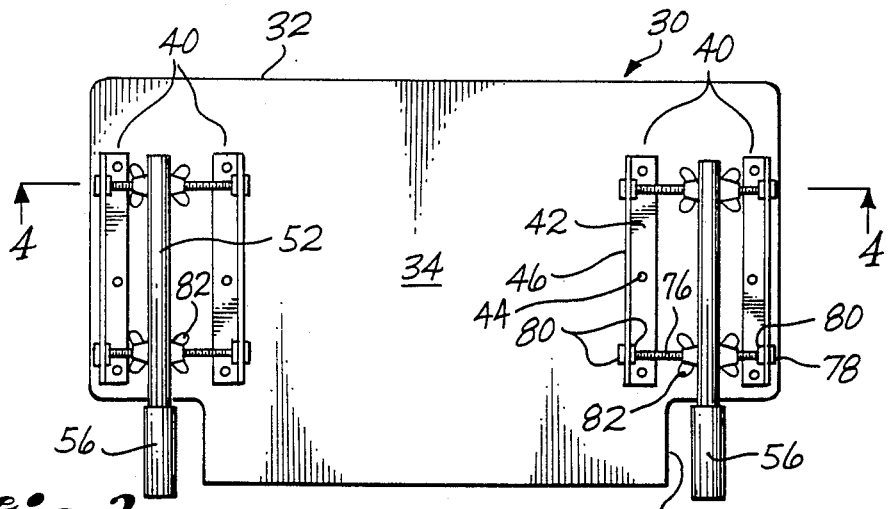
FIG. 3 is a bottom plan view of the attachment shown in FIGS. 1 and 2.
Figure 4:
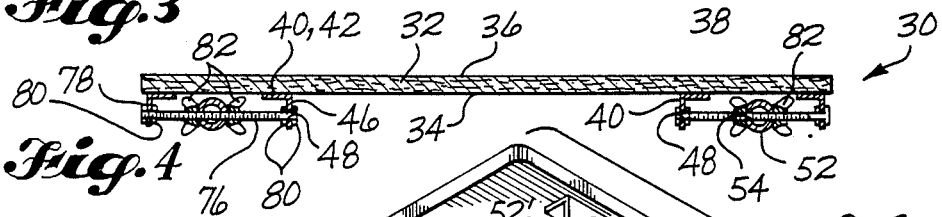
FIG. 4 is a sectional view taken along the line 4—4 in FIG. 3.

The manner in which the tubes 52 are secured to the tabletop 32 is best seen in FIGS. 2–4. A pair of angle irons 40 is secured to each side of the downwardly facing horizontal surface 34. Each angle iron 40 has an L-shaped cross section with a first horizontal leg 42 parallel to lower surface 34 and securely attached thereto by suitable fasteners, such as the screws 44 shown in the drawings. Each angle 40 also has a vertical leg 46 that extends vertically downwardly from surface 34 to form a vertical mounting flange 46. The flanges 46 of each pair are laterally spaced from each other and extend longitudinally along surface 34. Each flange 46 has a pair of longitudinally spaced openings 48 extending laterally therethrough aligned with the corresponding openings 48 in the other flange 46 of the pair.

Each of the two mounting tubes 52 extends longitudinally between the corresponding pair of flanges 46 and has a pair of laterally extending openings 54 extending therethrough and aligned with the openings 48 in the flanges 46. A bolt 76 extends through each set of aligned openings 48,54 and is secured to the corresponding flanges 46. The bolt 76 is threaded and is secured in place by means of nuts 80. One end of each bolt 76 has a head 78 that may be formed integrally with the threaded shaft of the bolt 76, as shown in FIG. 4, or may be formed by a nut 80, as shown in FIGS. 5 and 7. The openings 54 in the tube 52 and the threaded shafts of the bolts 76 are dimensioned so that the tube 52 is laterally slidable along the bolts 76. A wing nut 82 is threaded onto the shaft of each bolt 76 on each side of the tubular member 52. When the tube 52 has been moved to its desired lateral position, the wing nuts 82 are tightened against its opposite sides to secure it against further lateral movement with respect to bolt 76. Each tube 52 may be provided with one or more additional lateral openings to permit the position of the tabletop 32 to be adjusted longitudinally relative to the wheelchair seat to accommodate different size occupants.

FIGS. 6 and 7 show a second preferred embodiment of the attachment 30' that is designed for use with the type of armrest structure 4' shown in FIGS. 6 and 7. Attachment 30' has two mounting tubes 52' that are secured to a tabletop 32 in the same manner that the tubes 52 of the first embodiment are secured to a tabletop 32. The tubes 52' of the second embodiment differ from the tubes 52 of the first embodiment in that the rearwardly projecting end portion of the first embodiment is replaced by a clamp 60.

The clamp 60 has a U-shaped horizontal cross section and is securely attached to the end of the tubular portion of the mounting tube 52', preferably by welding. In the preferred embodiment shown in FIGS. 6 and 7, a brace 66 is welded to each clamp 60 and extends forwardly therefrom and is welded to the tubular portion to strengthen the attachment between the clamp 60 and the tubular portion. Each clamp 60 has two opposite generally vertical legs 62,64 for receiving the armrest frame member 18,20 therebetween. When the attachment 30' is secured to the armrest structure 4', the legs 62,64 of the clamp 60 are slid around the frame member 18,20 and then the legs 62,64 are moved together to firmly grip frame member 18,20. This is preferably accomplished by tightening a bolt 72. Each leg 62,64 has a hole 68 extending laterally therethrough, with the holes 68 in the two legs 62,64 being aligned to receive the bolt 72. The laterally inner leg 62 of each clamp 60 has a nut 70 welded to its outside surface with the hole in the nut being aligned with the hole in the leg 62. The bolt 72 is provided with a wing head 74 for ease of handling. When the bolt 72 is inserted into the aligned holes 68 and threaded through the nut 70, legs 62,64 are drawn together to firmly grip frame member 18,20.

Figure 8:
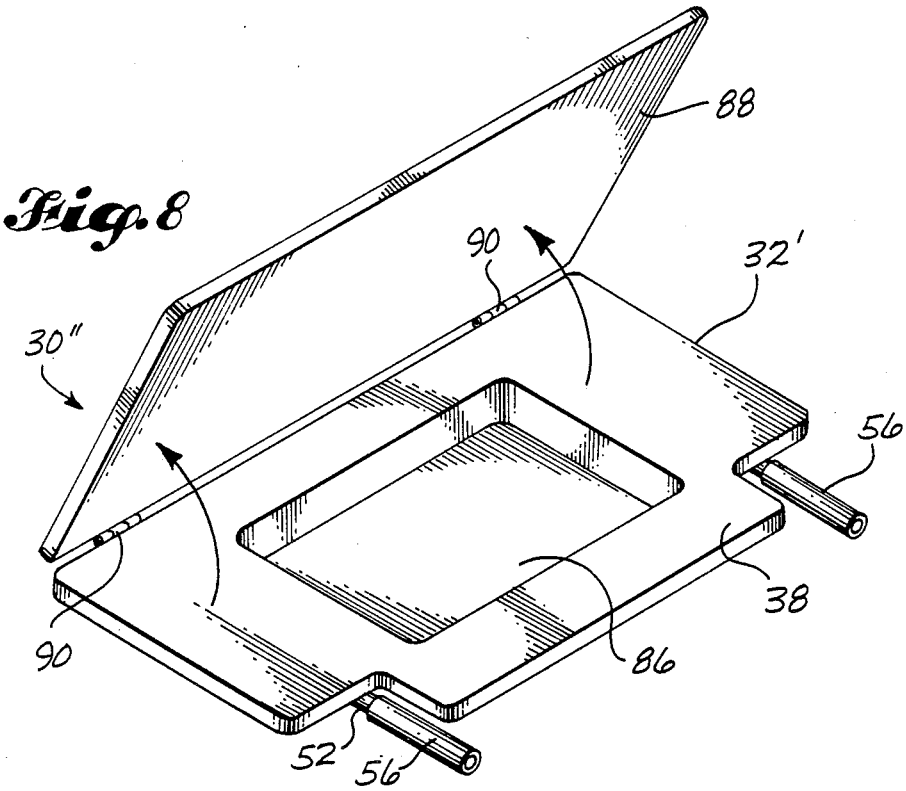
FIG. 8 is a pictorial view of a modification of the planar member of the attachment.

FIG. 8 illustrates a third preferred embodiment 30" of the attachment of the invention in which the tabletop 32 of the first embodiment has been replaced by a desk top arrangement 32',88. This type of desk top arrangement could also, of course, be used in an attachment having the type of wheelchair engaging means shown in FIGS. 6 and 7. The desk top 32',88 includes a flat board 32' similar to the board 32 shown in FIGS. 1–7 except that it has a central opening 86 extending vertically therethrough. This opening 86 is sized and positioned to receive a receptacle such as the type of desk pan found in some school desks. A cover 88 is attached to the front edge of the board 32' by a pair of hinges 90. The cover 88 opens and closes in the familiar manner of a school desk cover and has a closed position in which it rests on top of the board 32' and covers the central opening 86 and/or the receptacle received therein.

The operation of the attachment of the invention is very simple and generally may be easily carried out by the occupant of the wheelchair without assistance. In each embodiment, the distance between the two mounting members 52,52' is adjusted to the distance between the opposite sides of the armrest structure 4,4' by loosening the wing nuts 82, moving the tubular members 52,52' into the proper position, and then tightening the wing nuts 82. This adjustment procedure need only be made once unless the attachment 30,30',30" is used with more than one wheelchair.

With the tubular members 52 adjusted to their lateral positions and secured on the bolts 76, the embodiment 30 of FIGS. 1-5 is positioned with respect to the armrest structure 4 as shown in FIG. 2. Then, all that has to be done to secure the attachment 30 to the wheelchair 2 is to slide the rubber coated rear end portions 56 into the axial passageways 10. In the embodiment shown in FIGS. 6 and 7, the attachment 30′ is positioned as shown in FIG. 6 and then is moved rearwardly to position clamp legs 62,64 around frame members 18,20. The two bolts 72 are then inserted and tightened as described above to cause the clamps 60 to securely grip the frame members 18,20.

The embodiment of FIGS. 6 and 7 may be detached from the wheelchair simply by loosening the bolts 72 and sliding the attachment 30′ in a forward direction. The embodiment of FIGS. 1-5 may be detached from the wheelchair simply by pushing forwardly on the attachment 30 with sufficient force to overcome the frictional engagement between the rubber coating 56 and the inner sidewall of the frame member 6.

As noted above, the attachment of the invention is very strong. The applicant has conducted experiments to test the strength of the embodiment shown in FIGS. 1-5. The attachment easily supported a weight of 100 pounds. When a 165 pound person stood on the tabletop, the weld between the upper armrest frame member and the main wheelchair frame broke but the attachment remained intact and in its proper position.

Although the preferred embodiments of the invention have been illustrated and described herein, it is intended to be understood by those skilled in the art that various modifications and omissions in form and detail may be made without departing from the spirit and scope of the invention as defined in the following claims.

What is claimed is:

1. An attachment for a wheelchair or the like of the type having an armrest structure on each side thereof, comprising;

a rigid generally planar member positionable in front of an occupant of the wheelchair; said member having a substantially horizontal surface;

a pair of substantially vertical mounting flanges secured to each side of said horizontal surface and having aligned openings extending laterally therethrough;

an elongated member extending rearwardly along said horizontal surface between each pair of flanges; each such elongated member having an opening extending laterally therethrough aligned with the openings in the corresponding flanges;

means for adjustably securing each elongated member to the corresponding flanges, said means comprising a bolt extending through the aligned openings in each pair of flanges and the corresponding elongated member; means for securing each bolt to the corresponding flanges; and adjusting means for releasably securing each elongated member against lateral movement along the corresponding bolt, said adjusting means being releasable to permit the elongated member to be slid laterally along the bolt to adjust the distance between the elongated members to the distance between said armrest structures; and attaching means carried by each elongated member for releasably attaching such elongated member to a front portion of the corresponding armrest structure.

2. An attachment as described in claim 1, in which each armrest structure includes a substantially horizontal longitudinally extending frame member having a forward radial end and an axial passageway opening onto such end; and the attaching means comprises a rearwardly projecting end portion of each elongated member dimensioned to be closely received into the axial passageway in the corresponding frame member.

3. An attachment as described in claim 2, in which the attaching means further comprises a coating on each such end portion to provide a frictional engagement between such end portion and the frame member into which it is received, to prevent inadvertent movement of such end portion relative to the frame member.

4. An attachment as described in claim 1, in which the attaching means comprises clamp means secured to the rear end of each elongated member.

5. An attachment as described in claim 4, in which the clamp means comprises a U-shaped member having two opposite generally vertical leg portions for receiving a part of the armrest structure therebetween; and the attaching means further comprises means for moving said leg portions together to firmly grip said part of the armrest structure.

6. An attachment as described in claim 5, in which said leg portions have aligned openings extending laterally therethrough, a nut is welded to the outer surface of one such leg portion in alignment with the opening therethrough, and the means for moving the leg portions comprises a threaded bolt having a head portion with finger grip means.

7. An attachment as described in claim 1, in which the planar member includes an essentially flat board having an upper surface that serves as a tabletop for use by the occupant and an opposite lower surface which forms said horizontal surface.

8. An attachment as described in claim 1, in which the planar member comprises an essentially flat board having a central opening extending vertically therethrough for receiving a receptacle, and a lower surface forming said horizontal surface.

9. An attachment as described in claim 8, further comprising a cover hingedly attached to a front edge portion of said board and having a closed position in which it rests on top of said board and covers said central opening.

10. An attachment as described in claim 1, comprising an L-shaped member corresponding to each flange, each such L-shaped member having a first leg parallel to and securely attached to said horizontal surface, and a second leg which forms the corresponding flange.

11. An attachment as described in claim 1, in which each elongated member is a metal tube.

12. An attachment as described in claim 11, in which each flange and each elongated member has two longitudinally spaced openings extending laterally therethrough to form two sets of aligned openings, a threaded bolt extends through each such set of openings and is secured to the corresponding flanges, and the adjusting means includes a pair of nuts threadedly received onto each bolt on opposite sides of the corresponding elongated member.

* * * * *